United States Patent [19]

Gerber

[11] Patent Number: 4,653,362

[45] Date of Patent: Mar. 31, 1987

[54] CUTTING APPARATUS WITH HEATED BLADE FOR CUTTING THERMOPLASTIC FABRICS AND RELATED METHOD OF CUTTING

[75] Inventor: Heinz J. Gerber, West Hartford, Conn.

[73] Assignee: Gerber Scientific Inc., South Windsor, Conn.

[21] Appl. No.: 736,840

[22] Filed: May 22, 1985

[51] Int. Cl.[4] ..... B26D 5/10; D06H 7/00

[52] U.S. Cl. ..... 83/16; 83/74; 83/171; 83/925 CC

[58] Field of Search ..... 83/16, 170, 171, 74, 83/925 CC

[56] References Cited

U.S. PATENT DOCUMENTS

| | | | |
|---|---|---|---|
| 2,972,669 | 2/1961 | Brown | 83/170 X |
| 3,221,584 | 12/1965 | Novick | 83/170 |
| 3,259,004 | 7/1966 | Chisholm | 83/171 |
| 3,483,778 | 12/1969 | Forthmann, Jr. | 83/171 X |
| 3,486,957 | 12/1969 | Fish et al. | 83/171 X |
| 3,548,697 | 12/1970 | Gerber et al. | 83/925 CC |
| 3,631,751 | 1/1972 | Stumpf | 83/171 |
| 4,018,117 | 4/1977 | Patterson | 83/171 X |
| 4,132,519 | 1/1979 | Reed | 83/171 X |
| 4,161,898 | 7/1979 | Wingen | 83/171 |

FOREIGN PATENT DOCUMENTS

| | | |
|---|---|---|
| 200922 | 7/1923 | United Kingdom . |
| 589985 | 7/1947 | United Kingdom . |
| 878414 | 9/1961 | United Kingdom . |
| 995132 | 6/1965 | United Kingdom . |
| 1015464 | 12/1965 | United Kingdom . |
| 1504357 | 3/1978 | United Kingdom . |

*Primary Examiner*—James M. Meister

*Attorney, Agent, or Firm*—McCormick, Paulding & Huber

[57] ABSTRACT

An apparatus and method for automatically cutting piled or fleecy fabric sheets including thermoplastic fibers uses a heated cutting instrument to inhibit the generation of dust during the cutting process. The heated cutting instrument heats and melts at least some portion of at least some of the thermoplastic fibers which contact or near it, the melted material in turn capturing and holding to the sheets free cut fiber portions which might otherwise fall from the sheets to create dust. An induction coil or an electrical resistance heating material may be used to heat the cutting instrument, and a cooling means may also be used to aid in maintaining a desired cutting instrument temperature.

6 Claims, 14 Drawing Figures

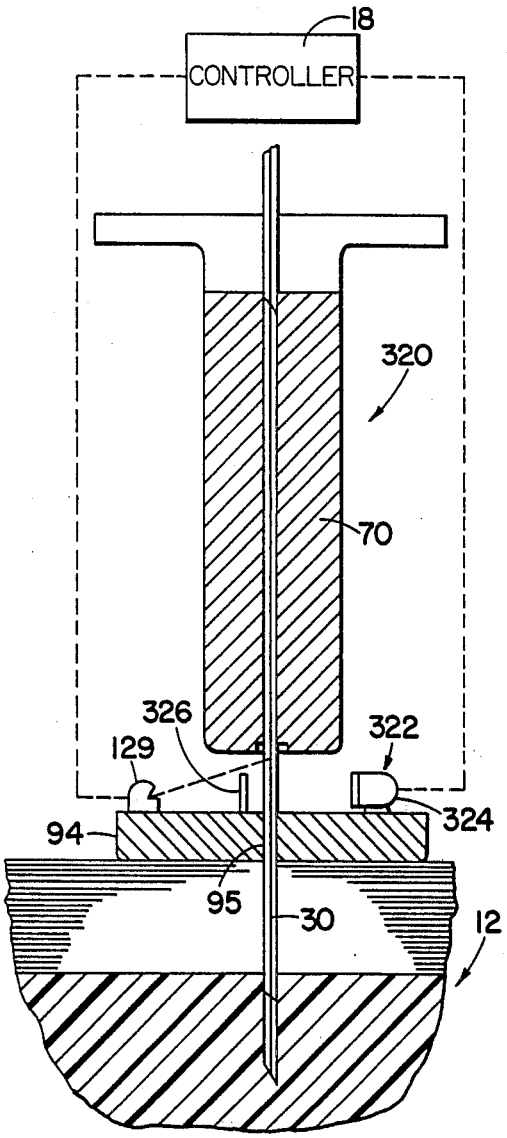
FIG. 14
FIG. 11
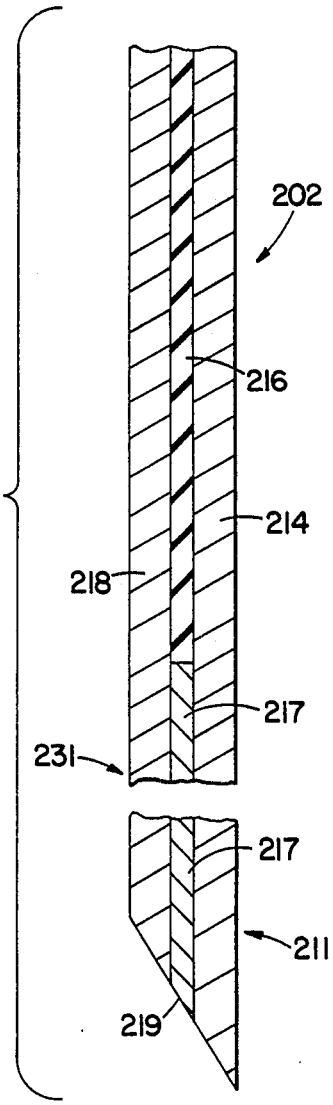

CUTTING APPARATUS WITH HEATED BLADE FOR CUTTING THERMOPLASTIC FABRICS AND RELATED METHOD OF CUTTING

BACKGROUND OF THE INVENTION

The invention relates generally to apparatus and methods for cutting sheet material and deals more particularly with an automatic cutting apparatus and method using a heated cutting blade for cutting piled or fleecy material, such as velour, made of thermoplastic fibers.

Automatic cutting apparatuses and methods are widely used today in the garment, automobile and furniture industries where much fabric is cut. Many of the cutting apparatuses are numerically controlled and are capable of cutting large quantities of pattern pieces from layups of sheet material with high speed and accuracy. For example, numerically controlled apparatuses are shown in U.S. Pat. Nos. 3,955,458 issued Sept. 17, 1973; 3,830,122 issued Aug. 20, 1974; and 4,091,701 issued May 30, 1978; each to Pearl and assigned to Gerber Garment Technology, Inc. of East Hartford, Conn. and hereby incorporated by reference as part of the present disclosure. Such numerically-controlled apparatuses may include a vertically-mounted reciprocating cutting blade, a horizontal bed for supporting the layup and a computer program to direct the cutting blade to cut the layup along a desired path to form the pattern pieces.

To insure cutting accuracy, it is often advantageous to positively affix the layup to the support bed while the layup is being cut and, if possible, compress the layup as disclosed in U.S. Pat. Nos. 3,495,492 issued Feb. 17, 1970; 3,790,154 issued Feb. 5, 1975; and 3,765,289 issued Oct. 16, 1973; each to Gerber et al and assigned to Gerber Garment Technology, Inc., and hereby incorporated by references as part of the present disclosure. As further disclosed in these patents, the layup may be covered with a substantially air-impermeable sheet, and a vacuum may be applied to the underside of the air-impermeable sheet to draw the impermeable sheet toward the support bed to fix and compress the layup while it is being cut.

Problems have emerged in the cutting of layups of piled or fleecy material, such as velour or velvet made of a carrier sheet and pile fibers attached to the carrier sheet, especially when the layups are compressed during cutting and the pile fibers have a significant length, such as one-thirty-second to one-eighth of an inch or more. During such compression, each work sheet is flattened under the pressure exerted by the sheet above and the free ends of the pile fibers are generally bent downwardly towards the carrier sheet. Consequently, many of the pile fibers invariably cross the path of the cutting blade as the layup is cut and portions of such pile fibers are cut off and freed from the remainder of the worksheet. When the cutting operation is complete, the bundles of pattern pieces are usually transported to a subsequent work site and during this transportation many of the free cut fiber portions may fall loose from the bundle as dust. This dust is unsightly, may lodge in machinery and is generally objectionable in many other ways.

In other types of cutting apparatuses layups of piled or fleecy sheets may be cut without a holddown or compression system. In such an arrangement, many of the pile fibers are cut but the number cut is usually fewer than the number cut by a cutting apparatus using holddown and compression, because the pile fibers in a non-holddown system are bent less during the cutting process than in the vacuum holddown system described above and therefore fewer pile fibers cross the path of the cutting blade. Also, if dies are used to cut a layup of piled or fleecy sheet material, pile fibers crossing the line of cut may be cut to create pile dust. Even if a single sheet of such material is cut by a reciprocating knife or die without a holddown system some pile fibers are cut although usually much fewer than are cut from a sheet in a layup of such material cut under compression.

The pile fibers and/or carrier sheets of piled or fleecy work sheets, such as velours, are often made of polyester or other thermoplastic material, as for example in the case where the pattern pieces are to be used for making automobile seats or other objects requiring highly-durable and washable coverings.

Accordingly, a general aim of the invention is to provide an automatic cutting apparatus and method for cutting piled material, such as velour, made of thermoplastic fibers and which cutting apparatus and method minimizes the amount of dust generating free fibers created during a cutting operation.

Another object of the invention is to provide a cutting apparatus of the foregoing type which does not appreciably interfere with an otherwise conventional cutting operation and which does not degrade the quality of the pattern pieces cut during the cutting operation.

SUMMARY OF THE INVENTION

The present invention resides in an apparatus and method which efficiently cuts piled or fleecy work sheets made of thermoplastic fibers without creating an objectionable amount of dust. A cutting apparatus embodying the invention includes a cutting instrument, such as a cutting blade or a die, a means for moving the cutting instrument into cutting engagement with the piled or fleecy worksheets, and a means for actively heating the cutting instrument so that when pile fibers of the sheets are cut by the cutting instrument, the cut free ends of the fibers are fused to the edge of either the pattern pieces of the scrap pieces cut from the worksheets. The heating means may take various forms, such as an induction coil surrounding the cutting instrument or heating wires or other electrical resistance heating material associated with and possibly forming a part of the cutting instrument. Also the cutting apparatus may include a temperature sensor and an auxillary cooling system permitting the temperature of the cutting instrument to be closely regulated.

BRIEF DESCRIPTION OF THE DRAWINGS

FIG. 11 is a greatly enlarged, vertical cross-sectional fragmentary view of the cutting blade of FIG. 10.

FIG. 14 is a cross-sectional, fragmentary plan view of another automatic cutting apparatus embodying the invention.

DETAILED DESCRIPTION OF THE PREFERRED EMBODIMENTS

Figure 1:
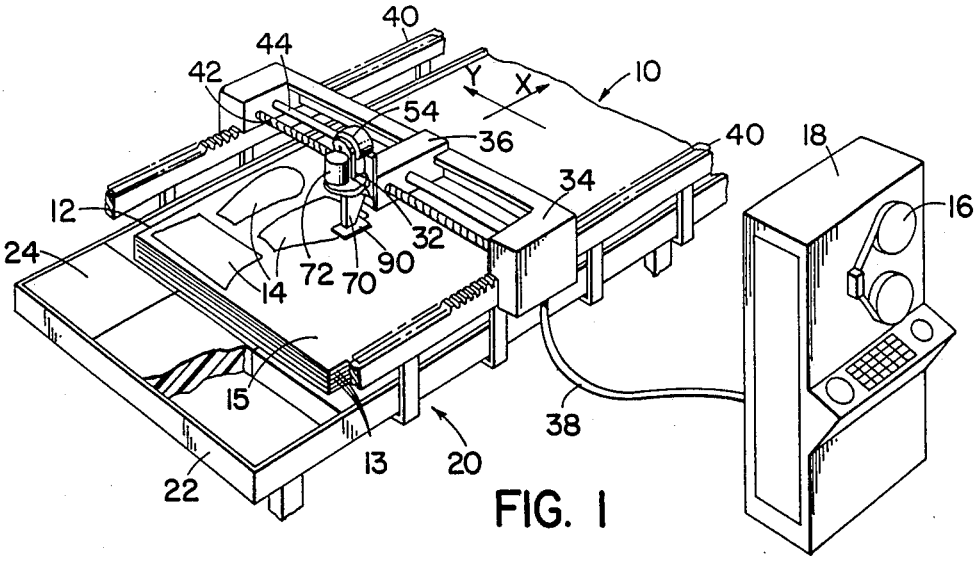
FIG. 1 is a perspective view of an automatic cutting apparatus embodying the present invention.

FIG. 1 shows a numerically controlled cutting machine, generally designated 10, in which the present invention is utilized. The cutting machine 10 works on a stack or layup 12 of worksheets 13, 13 to cut out a plurality of bundles of pattern pieces 14 in response to digitized information on a program tape 16. The tape 16 is read by a computerized controller 18 which, among other things, converts the information into motor commands transmitted to the cutting table 20 of the machine 10. The table includes a frame 22 containing a penetrable bed 24 having a support surface on which the sheet material is spread to form the layup 12. The bed 24 may be constructed of blocks of foamed plastic or bristled mats that can be easily penetrated by a cutting tool which plunges through the layup from above. A vacuum holddown system, such as that disclosed in U.S. Pat. No. 3,495,492 referenced above, may be utilized to hold the layup in position on the table during a cutting operation, such system including a plastic overlay 15 and a source of vacuum which draws the overlay 15 towards the cutting table 20 to hold down and compress the layup 12.

The machine 10 also includes a cutting instrument in the form of a reciprocating knife blade 30 preferably made of a hard metal such as stainless steel. The blade 30 is part of a cutting head 32 and is suspended in cantilevered fashion at its upper end from the remainder of the cutting head 32 which rotates under the influence of a controlled drive motor (not shown) about a $\theta$ axis (FIG. 2) coincident with the leading, cutting edge of the blade, and the blade is slidably supported in a guide slot 75 (FIG. 3) in a block 70 forming part of the cutter head. The cutter head 32 is in turn supported above the bed 24 by a Y-carriage 36 and an X-carriage 34. The X-carriage 34 is translatable over the bed in the illustrated X-direction and the Y-carriage 36 in translatable on the X-carriage and relative to the bed in the illustrated Y-direction. Motor commands from the controller 18 are transmitted through the cable 38 to motors (not shown) which drive the X- and Y-carriages. The X-carriage 34 has pinions (not shown) which engage racks 40 at each side of the table 20 to accurately position the carriage in the longitudinal or X-direction. A lead screw 42 extending transversely of the table and carried by the X-carriage 34 engages the Y-carriage 36 to accurately position the carriage in the lateral or Y-direction. A guide bar 44 extending parallel to the lead screw provides a guide track or rail for the X-carriage for movement in the Y-direction.

Figure 2:
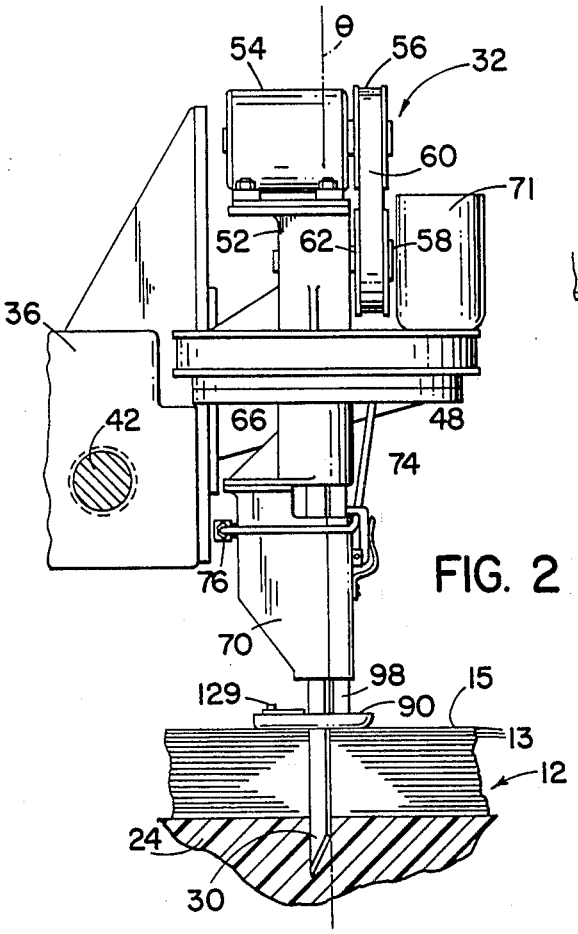
FIG. 2 is a plan view of a cutting head of the cutting apparatus of FIG. 1.

As shown most clearly in FIG. 2, the cutter head 32 is mounted on an elevating platform 48 at the projecting end of the X-carriage 36. The platform 48 is moved vertically between upper and lower limits relative to the carriage 36 by through a motor (not shown) controlled by the controller 18. The platform 48 is illustrated at its lower limit in FIG. 2 and in this position the reciprocating blade at the lower end of its stroke pierces through the layup 12 and into the penetrable bed 24. When the platform 48 is at the upper limit of its movement relative to the carriage 36, the blade is supported above and entirely disengaged from the layup.

Mounted on a pedestal 52 at the upper portion of the cutting head is a motor 54 connected to the reciprocating blade 30 by means of drive pulleys 56 and 58 and drive belt 60. The pulley 58 is mounted on the end of and drives a shaft 62 which forms part of a crank or eccentric mechanism for reciprocating the blade 30 when the motor 54 is operating.

Suspended from a lower pedestal 66 of the cutter head 32 is the guide block 70 in which the blade 30 reciprocates. Thus it can be appreciated from the foregoing that the supporting and driving mechanism for the blade 30, including the motor 54 and the guide block 70, is movable up and down relative to the bed 24 along with the remainder of the cutter head 32 and the elevating platform 48. Also, the blade supporting and driving mechanism rotates with the cutter head about the $\theta$ axis. With such a supporting and driving mechanism, the blade 30 may be plunged through the layup 12 at any point on the bed 24, can be moved along any desired line of cut relative to the layup 12, and can be rotated into a position tangent to the line of cut at each point along such line. Therefore, a plurality of pattern piece bundles can be cut from the layup at different regions of the cutting table 20 in response to the information programmed on the tape 16.

Figure 3:
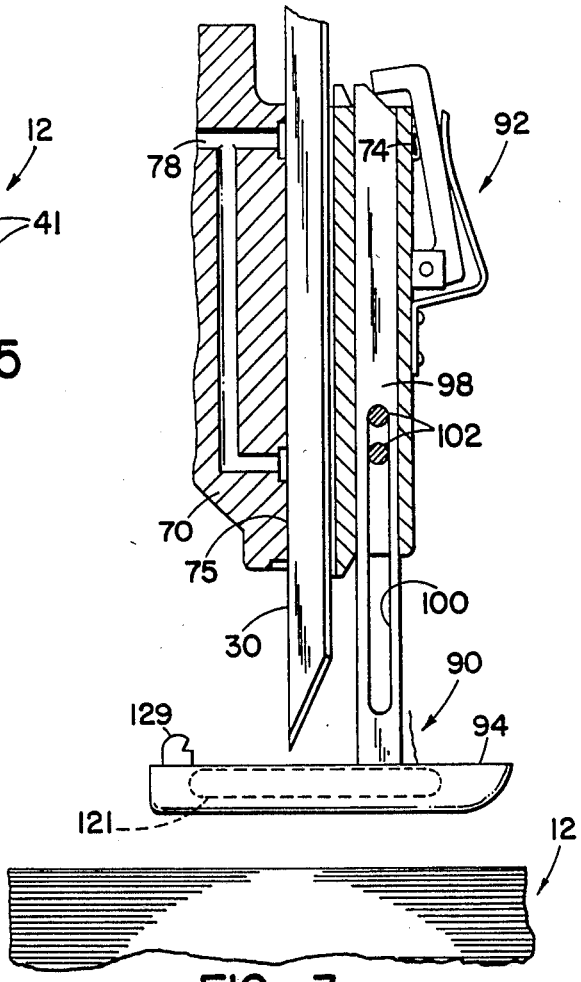
FIG. 3 is cross-sectional, fragmentary plan view of the cutting head of FIG. 2, including a cutting blade shown in a retracted position.
Figure 6:
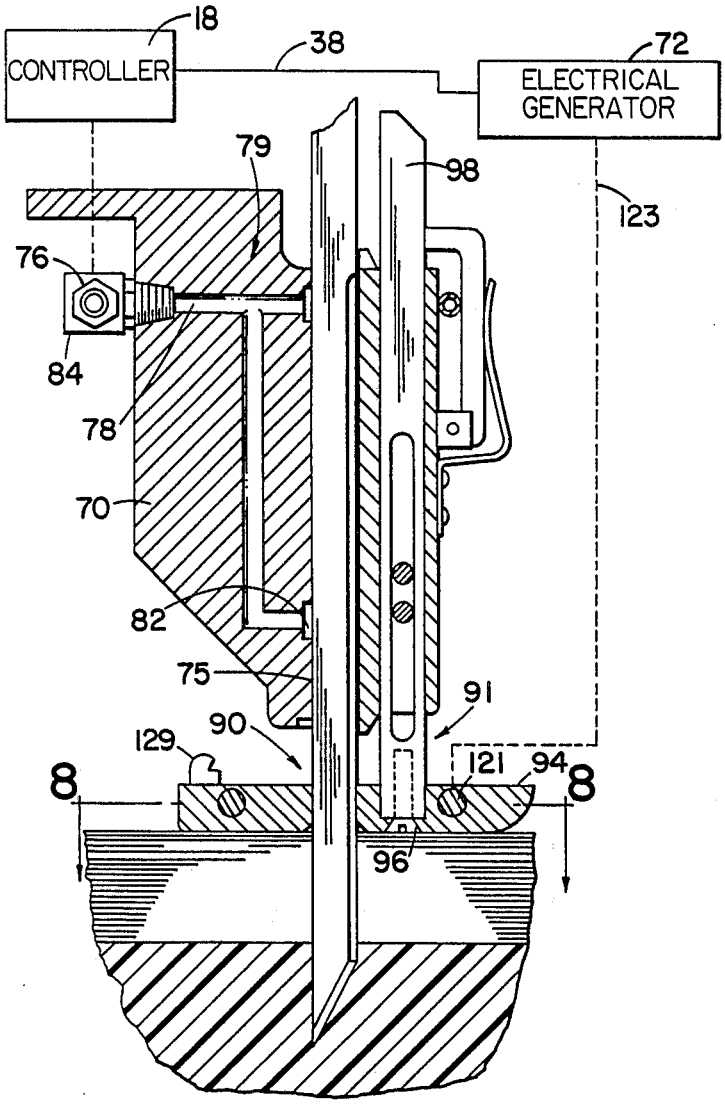
FIG. 6 is vertical side cross-sectional fragmentary view of the cutting head shown in FIG. 2 and illustrates the cutting blade after penetrating the layup of FIG. 5.

FIGS. 2, 3 and 6 show a presser foot 90, comprised generally of a hard plastic pressure plate 94, fixedly secured by a screw 96 to the lower end of a hard plastic support rod 98 depending vertically from the guide block 70. The plate 94 has a central cutout 95 accommodating the blade 30. The support rod 98 is supported to slide vertically within a channel in the guide block 70 in a direction parallel to the reciprocation of the blade 30 by means of a pair of dowels 102 fixed to the block and extending through a slot 100 in the rod. The slot 100 and dowels 102 allow the lower pressing surface of the pressure plate 94, if desired, to rest on the top the layup 12 under the weight of the foot 90 to help compress the layup in the vicinity of the blade 30.

Figure 4:
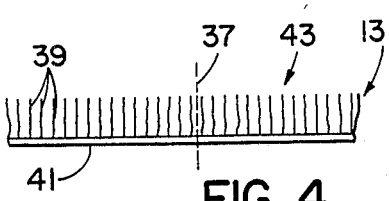
FIG. 4 is an enlarged, fragmentary side view of a single worksheet of a piled or fleecy material which may be cut by the cutting apparatus of FIG. 1.

FIG. 4 shows a single worksheet 13 of the layup 12 as the worksheet 13 exists apart from the layup and free of any external interference or forces. This worksheet 13 comprises a pile made of pile fibers 39, 39 and a carrier sheet 41 to which the pile fibers 39, 39 are attached at one end. The pile fibers 39, 39 and the carrier sheet 41 may be made of a variety of materials; however, the present invention is concerned with the case where at least one and usually both of these components (pile fibers and carrier sheet) are made entirely or at lest in part of thermoplastic material or materials. As a common example each worksheet may be a velour fabric wherein both the pile fibers and the carrier sheet are made of polyester fibers having a melting point in the range of 300° to 400° F.

Figure 5:
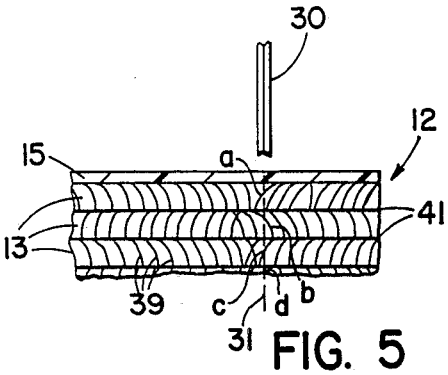
FIG. 5 is an enlarged fragmentary perspective view of a layup of a number of piled or fleeced worksheets such as those of FIG. 4, which layup may be cut by the cutting apparatus of FIG. 1.

The pile fibers 39, 39 usually are on the order of be one-thirty-second inch to one-eighth inch long and are free at their ends opposite the carrier sheet. In the unstressed condition shown in FIG. 4, the pile fibers extend upwardly from the carrier sheet 41 generally parallel to one another to collectively form a pile or fleece 43. With the pile fibers extending substantially vertically, a blade may cut along a line of cut or penetration 37, shown in broken lines in FIG. 4, and avoid cutting many of the pile fibers adjacent the line of cut. However, for cutting purposes a worksheet 13 is often stacked with other similar worksheets 13, 13 to form the layup 12, as shown in FIG. 5, with a plastic sheet 15 placed over the layup and a vacuum applied underneath the layup. FIG. 5 further shows the cutting blade 30 as it penetrates into the layup 12 along a line 31 during cutting. Due to the compression of the layup 12, the pile fibers 39, 39 of each worksheet are bent downwardly toward the associated carrier sheet 41 so that when the blade cuts the layup, as along the line 31, portions of some of the pile fibers 39, 39, indicated at A, B, C and D are cut from the remainder of the worksheets 13, 13 either from the pattern pieces or from the scrap portions, because of pile fibers crossing the blade line 31.

As the blade 30 cuts the worksheets 13, 13, friction generated by the rubbing of the blade against the worksheets frictionally heats the blade, pile fibers adjacent the line of cut and the cut edges of the carrier sheets. The degree of this heating is usually low and is dependent on a number of factors such as coefficients of friction, the number of worksheets in the layup, their resistance to being cut, the rate of reciprocation of the blade, the speed of the blade along the line of cut and the sharpness of the blade. In conventional cutting this frictional heating by itself is usually not sufficient to cause any melting of thermoplastic fibers being cut.

Figure 7:
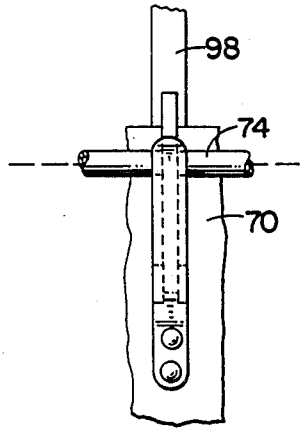
FIG. 7 is a fragmentary view of the cutting head of FIG. 2.
Figure 8:
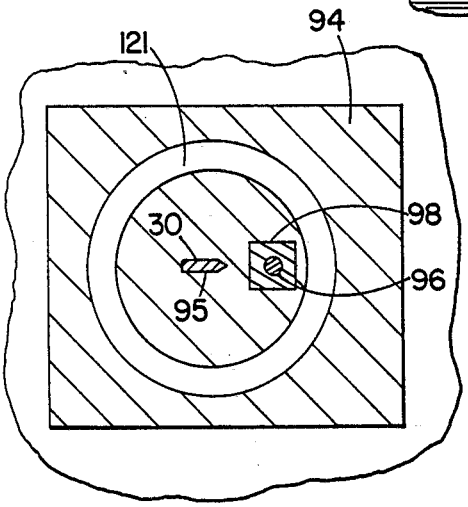
FIG. 8 is a fragmentary sectional view of the cutting head of FIG. 2.

Focusing now on the present invention, a cutting head 91 with a heated blade is illustrated in FIGS. 6, 7 and 8, and comprises an electrical generator 72 which at times delivers an alternating current via an electrical cable 123 to a toroidal induction-heating coil 121 embedded within the presser foot 94. Since the blade 30 is made of stainless steel or other hard metal, eddy currents are induced within the blade 30 causing it to heat up. The induction heating supplements the frictional heating (if any) and in accordance with the invention is set at a level to maintain the blade 30 at a temperature slightly above the melting point of the pile fibers. The magnitude of the eddy currents and thus the level of inductive blade heating depends primarily on the magnitude and frequency of the current delivered to the coil 121. As the so heated blade 30 cuts the layup 12, the blade 30 conducts heat to the pile fibers 39, 39 contacting the blade, including cut pile fiber portions such as shown A, B, C and D, and also conducts heat to the cut edges of the carrier sheets 41, 41 contacting the blade. As a result of this heating portions of various fibers which contact the blade are melted for a short period of time and the melted material so formed causes the cut pile fiber portions, which might otherwise cause dust, to be bonded, either in melted, unmelted or partially melted form, to either the material of the cut pattern pieces or the material of the surrounding scrap without the bonding causing the pattern pieces to adhere significantly to the scrap or adjacent pattern pieces to adhere to one another. The degree of heating may therefore be characterized as one causing a slight singeing of the edges of the pattern pieces and the edges of the scrap. As a result of this, most if not all of the free cut pile fiber portions fuse to either the pattern pieces or the scrap and are not available to generate dust.

To form a closed loop heating system for the blade 30, an infrared sensor 129 senses the temperature of the blade 30 and transmits an electrical signal indicative of the temperature to the controller 18 via the cables 123 and 38. If the cutting blade 30 is below a desired set temperature, the controller 18 causes the generator 72 to increase the magnitude and/or the frequency of the current to the coil 121 to increase the inductive heating of the blade 30.

Excessive blade heating should be avoided to avoid fusing of the cut pattern pieces to one another or to the surrounding scrap. Therefore, if the blade 30 gets too hot the controller shuts off or reduces the induction heating by ceasing or cutting down on the delivery of current to the coil 121. If desired, an auxillary cooling system may also be provided to aid in maintaining proper temperature of the blade. An example of such a system is shown at 79 shown in FIGS. 2, 3, 6 and 8 and is of the type shown in U.S. Pat. No. 3,830,122. This cooling system 79 includes a bottle 71 containing a cooling liquid such as water, a flexible liquid conduit in the form of a plastic tube 74 leading from the bottle 71 to a fitting 76 on the blade guide block 70, and a channel 78 drilled within the block 70 leading to a port 80 adjacent the upper end of the guide slot 75 and another port 82 adjacent the lower end of the guide slot. An adjustable metering valve 84 under the control of the controller 18 regulates the flow of liquid from the bottle 72 to the blade 30. As the liquid is dispensed from the ports 80 and 82, it flows down the blade 30, and thereby cools it. Consequently, the temperature of the blade may be controllably heated and/or controllably cooled to maintain the proper blade temperature for achieving the desired results.

In place of the cooling system described above a simple water jet may be provided to spray a stream of cooling water onto the blade, under control of the controller, to rapidly cool the blade when an overheated condition is detected by the sensor 129.

Figure 9:
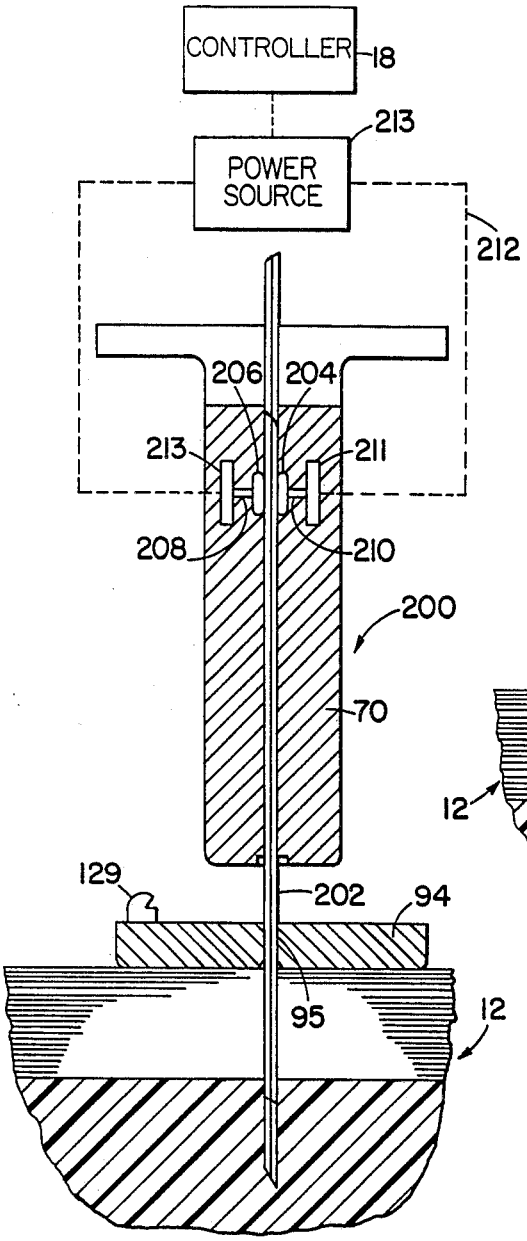
FIG. 9 is a vertical fragmentary cross-sectional view of another cutting head embodying the invention.
Figure 10:
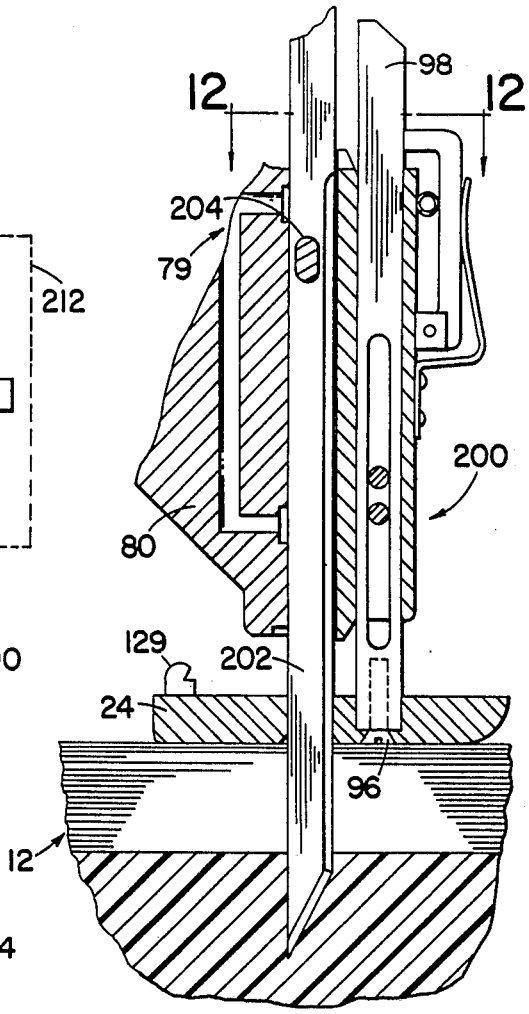
FIG. 10 is a vertical fragmentary cross-sectional view of the cutting head of FIG. 9.
Figure 12:
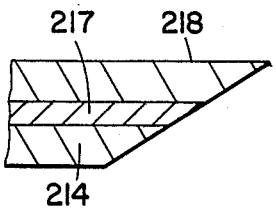
FIG. 12 is a greatly enlarged, fragmentary cross-sectional view of the blade taken along the line 12—12 of FIG. 9.

FIG. 9 illustrates a cutting head 200 comprising another embodiment of the invention and having a blade heated by electrical resistance heating means. This head 200 may be used in the cutting apparatus 10 as a substitute for the cutting head shown in FIG. 6. The head 200 comprises a cutting blade 202, electrical contact brushes or pads 204 and 206 which slidably engage the blade, and electrically conductive members 210 and 208 which support the brushes 204 and 206, respectively. Brackets 211 and 213 mount the members 210 and 208, respecitvely, to a block 80. Wires 212 and 214 connect a power source 213 to the support bars 210 and 208. The cutting blade 202 includes outer layers 214 and 218 between which is sandwiched an upper insulating layer portion 216 and a lower resistance heating portion 217. The cutting layers 214 and 218 are made of stainless steel, or some other metal, hard enough to resist wear when engaging the layup and electrically conductive. The lower end or tip 211 of the cutting blade 202 is sharpened with a single bevel to minimize wear on the exposed surface 219 of the resistive portion 217. The insulating portion 216 may be made of Mylar or electrical insulating material epoxied or otherwise bonded between the layers 214 and 218. The heating portion 217 is made of a suitable electrical resistance material of the type commonly used for resistance heaters and is also suitably bonded to the layers 214 and 218.

The brush 204 engages the metal layer 214 of the blade 202 and makes an electrical contact therewith both when the blade is stationary and when it reciprocates. Similarly, the brush 206 makes an electrical contact with the metal layer 218 both when the blade is stationary and when it reciprocates. To resistively heat the blade 202, a voltage, AC or DC, is applied between the brushes 204 and 206 through the associated support members 210 and 208, causing a current to flow from one brush, down one cutting layer, through the resistance heating portion 217 and up the other cutting layer to the other brush. Consequently, the resistance heating layer portion 217 heats up, conducts heat to the cutting portion 231 of the blade and heats the fibers of the worksheets in the same manner as described above for the blade 30. Although not shown, the blade 202 may also have associated with it a cooling system such as that described above for the blade 30.

Figure 13:
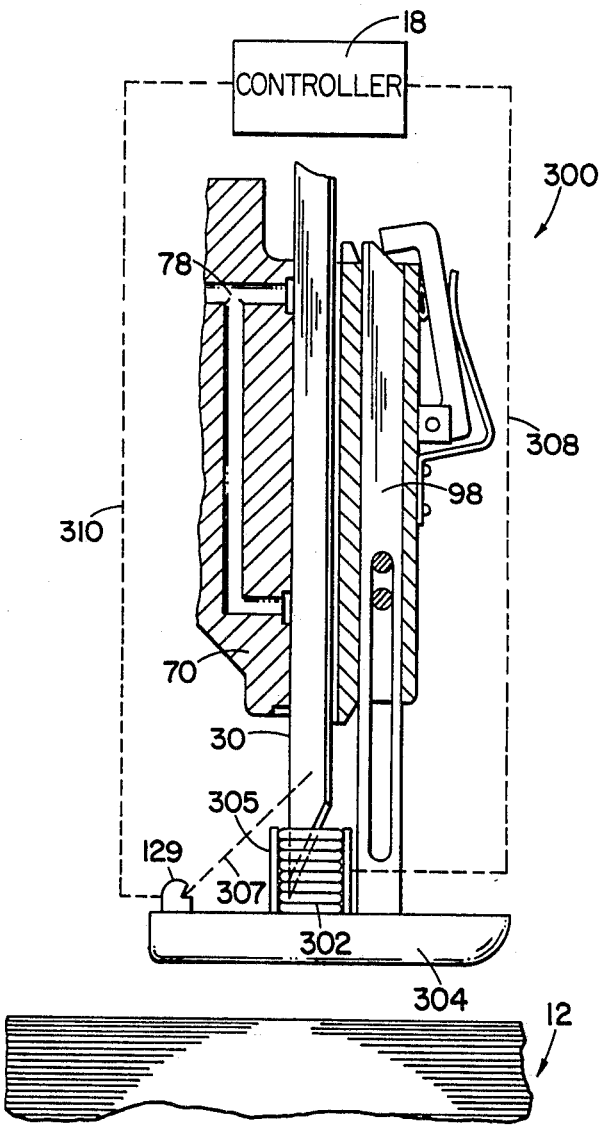
FIG. 13 is a cross-sectional, fragmentary plan view of another automatic cutting apparatus embodying the invention.

FIG. 13 illustrates a cutting head 300 comprising another embodiment of the invention in which a coil 302 of electrically resistive wire radiantly heats the blade 30. The coil is mounted to a pressure plate 304 with its axis vertical and surrounds the blade 30 as it reciprocates. As indicated schematically by a broken line 308, the controller 18 supplies electrical current to the coil to cause it to heat up and radiate heat to the blade 30. As indicated schematically by broken line 310, the controller utilizes feedback from the infrared sensor 129 to determine the proper level of heating; and so, the required amount of current to deliver to the coil 302. By way of example, the wires of the coil 302 may be of the type found in ordinary, household space heaters. The pressure plate 304 is made of ceramic to withstand the heat and to insulate the overlay and top sheets of the layup 12 from the heat. Also, an insulating casing 305 surrounds the outer perimeter of the coil 302 to confine the heat produced by the coil to the vicinity of the blade 30.

FIG. 14 illustrates a cutting head 320 comprising another embodiment of the invention in which a heat lamp 322 radiantly heats the blade 30. By way of example, the lamp 322 is of the quartz-halogen variety with internal focusing caused by the internal curvature and the internal reflectivity of a shell 324 of the lamp.

The lamp 322 is focussed upon the blade 30, and is periodically excited by currents supplied from the controller 18 so that the lamp is activated when the blade is in the downward portion of its reciprocating cycle and in the path of the lamp's beam and is de-activated when the blade is up and out of the path. Also, the lamp 322 is de-activated when the controller senses, by means of the infrared sensor 129, that the blade 30 is too hot. A rectangular shield 326 is mounted to the pressure plate 94 in the path of the lamp's beam to absorb the heat of the beam in the event that the controller errs in coordinating the timing of the activation of the lamp with the reciprocation of the blade. The infrared sensor 129 peers over the shield 326 to scan the temperature of the blade.

By the foregoing, automatic cutting apparatuses including heated cutting blades for preventing the generation of dust have been disclosed. However, numerous modifications and substitutions may be made without deviating from the spirit of the invention.

For example, instead of the infrared temperature sensor, a contact temperature sensor such as a thermocouple may be connected directly to the blade 30 or 202 to measure its temperature.

Also, it is possible to operate the heating system of either the FIG. 1 embodiment or the FIG. 9 embodiment open loop, without the temperature sensor 129, by providing a manually controlled potentiometer dial on the electrical generator 72 or on the electrical power source 210 to manually control the power delivered to the induction coil 121 or to the resistance heating portion 217 as the case may be. In this case if an operator observes that the pattern pieces are beginning to fuse to one another or to the scrap after the cutting blade makes its cut, he can lower the heat output. On the other hand, if the operator observes free cut pile fibers, he can then increase the heat output to obtain better capture of such cut fibers.

In an open loop system, it is also possible to program the controller 72 to cause the generator 72 or the electrical power source 210 to output a predetermined voltage waveform, and therefore to produce the production of heat at a predetermined rate, dependent on the type of worksheets to be cut, the number of worksheet layers in each layup, the rate of blade reciprocation, the speed of the blade along the line of cut and/or other parameters. Such pre-programmed data, or characteristic curve, may be obtained by previous experiment.

It is also possible to heat the cutting blade in various other ways. For example, the insulating portion 216 of the blade 202 may be replaced altogether by a layer of electrical resistance heating material such as that of the portion 217. Also, electrical resistance heating wires may be embedded within a blade instead of using the resistiance heating portion 217. Also, an auxillary cooling system employing an air jet aimed at the lower portion of the blade 30 may be substituted for the liquid cooling system shown in FIG. 6. Utilizing either type of cooling system or none at all, the controller 18 may simply shut off the cutting apparatus 10 or 200 when the blade gets too hot and may also sound an alarm to alert an operator.

Therefore, the invention has been disclosed by way of example and not by limitation.

I claim:

1. An automatic cutting apparatus for cutting a fabric sheet made up at least in part of thermoplastic fibers, said apparatus comprising:

means providing a supporting surface for supporting a fabric sheet such as aforesaid in a spread condition, an elongated blade having a sharp forward cutting edge for cutting a fabric sheet such as aforesaid spread on said supporting surface, means for reciprocating said blade along an axis generally perpendicular to said supporting surface and for moving said blade along a line of cut relative to said supporting surface while said sharp forward cutting edge engages a fabric sheet supported on said supporting surface to cut said sheet along said line of cut by severing said sheet with said sharp forward edge of said blade, means for sensing the temperature of said blade, induction heating means having a heating field and responsive to information provided by said sensing means for controllably heating said cutting blade while said blade reciprocates to such a temperature that as said sharp forward cutting edge of said blade cuts said sheet, free portions of fibers cut by said cutting blade are captured and held to said sheet as a result of the melting of at least some portion of at least some of the thermoplastic fibers of said sheet due to their contact with or nearness to said heated cutting blade but cuts in the sheet are not substantially refused, and means supporting said induction heating means for movement with said blade relative to said supporting surface along said line of cut and such that said blade reciprocates within said heating field of said induction heating means, said means for sensing the temperature of said blade does so while said blade reciprocates, said means for controllably heating said blade further comprises means responsive to the temperataure sensing means for varying the amount of heat provided by said induction heating means to said blade to control the temperature of said blade, and the reciprocating means reciprocates said blade relative to said means for sensing the temperature of said cutting blade.

2. The apparatus set forth in claim 1 further comprising means, responsive to the temperature sensing means, for cooling said cutting blade.

3. The apparatus set forth in claim 1 wherein the controllable heating means further comprises means responsive to the sensing means for controlling the amount of heat provided by said heating means to said cutting blade.

4. The apparatus set forth in claim 3 wherein the sensing means comprises an infrared temperature sensor supported outside the field of said induction heating means.

5. A method for cutting a sheet of fabric made up at least in part of thermoplastic fibers, said method comprising the steps of:

providing a sheet of fabric to be cut which sheet is made up at least in part of thermoplastic fibers, providing a cutting blade for cutting said sheet, plunging a tip of said cutting blade through said sheet and reciprocating said cutting blade relative to a heating element, a heating field of said heating element and said sheet to cause it to cut said sheet, actively heating said cutting blade by said heating element while reciprocating the blade, sensing the temperature of said cutting blade, and controlling the heating of said cutting blade in response to the sensing of the temperature of said cutting blade to maintain the temperature at a predetermined level, the step of sensing the temperature of said cutting blade being performed by using an infrared sensor.

6. An automatic cutting apparatus for cutting a fabric sheet made up at least in part of thermoplastic fibers, said apparatus comprising:

means providing a supporting surface for supporting a fabric sheet such as aforesaid in a spread condition, an elongated blade having a sharp forward cutting edge for cutting a fabric sheet such as aforesaid spread on said supporting surface, means for reciprocating said blade along an axis generally perpendicular to said supporting surface and for moving said blade along a line of cut relative to said supporting surface while said sharp forward cutting edge engages a fabric sheet supported on said supporting surface to cut said sheet along said line of cut by severing said sheet with said sharp forward edge of said blade, means for sensing the temperature of said blade, induction heating means having a heating field and responsive to information provided by said sensing means for controllably heating said cutting blade while said blade reciprocates to such a temperature that as said sharp forward cutting edge of said blade cuts said sheet, free portions of fibers cut by said cutting blade are captured and held to said sheet as a result of the melting of at least some portion of at least some of the thermoplastic fibers of said sheet due to their contact with or nearness to said heated cutting blade but cuts in the sheet are not substantially refused, and means supporting said induction heating means for movement with said blade relative to said supporting surface along said line of cut and such that said blade reciprocates within said heating field of said induction heating means, said blade and said means for reciprocating said blade being part of a cutting head and further comprising a presser foot carried by said cutting head for engaging said sheet material, said presser foot having an opening through which said blade reciprocates, and wherein said induction heating means is mounted on said presser foot.

* * * * *